United States Patent [19]

Anzinger

[11] Patent Number: 4,485,618

[45] Date of Patent: Dec. 4, 1984

[54] APPARATUS FOR WITHDRAWING A THREAD FROM A SPINNING STATION

[75] Inventor: Rupert Anzinger, Traun, Austria

[73] Assignee: Textilmaschinenfabrik Dr. Ernst Fehrer Aktiengesellschaft, Leonding, Austria

[21] Appl. No.: 442,146

[22] Filed: Nov. 16, 1982

[30] Foreign Application Priority Data

Nov. 18, 1981 [AT] Austria ..... 4965/81

[51] Int. Cl.[3] ..... D01H 1/12; D01H 13/06

[52] U.S. Cl. ..... 57/352; 57/62; 57/90; 57/401; 242/43.2; 242/157.1

[58] Field of Search ..... 57/352, 263, 90, 91, 57/62, 261, 400–405, 414–417; 226/181–184; 242/43 R, 43 A, 157 C, 43.2, 157 R, 157.1

[56] References Cited

U.S. PATENT DOCUMENTS

| | | | |
|---|---|---|---|
| 3,112,054 | 11/1963 | Fleissner | 226/95 |
| 3,414,205 | 12/1968 | Aschwanden | 242/43.2 |
| 4,060,207 | 11/1977 | Miyazaki et al. | 57/263 X |
| 4,362,008 | 12/1982 | Parker et al. | 57/401 X |

*Primary Examiner*—John Petrakes

*Attorney, Agent, or Firm*—Kurt Kelman

[57] ABSTRACT

Apparatus for withdrawing a thread from a spinning station comprises at least two withdrawing rollers, which are preceded by a reciprocating thread guide and are succeeded by a winding device, which comprises a traversing device. In order to ensure that a reciprocating motion will be imparted to the thread guide, the latter is provided on one arm of a double-armed lever, which is freely rotatably mounted and provided on its other arm with another thread guide which is disposed between the withdrawing rollers and the traversing device.

4 Claims, 3 Drawing Figures

APPARATUS FOR WITHDRAWING A THREAD FROM A SPINNING STATION

Figure 1:
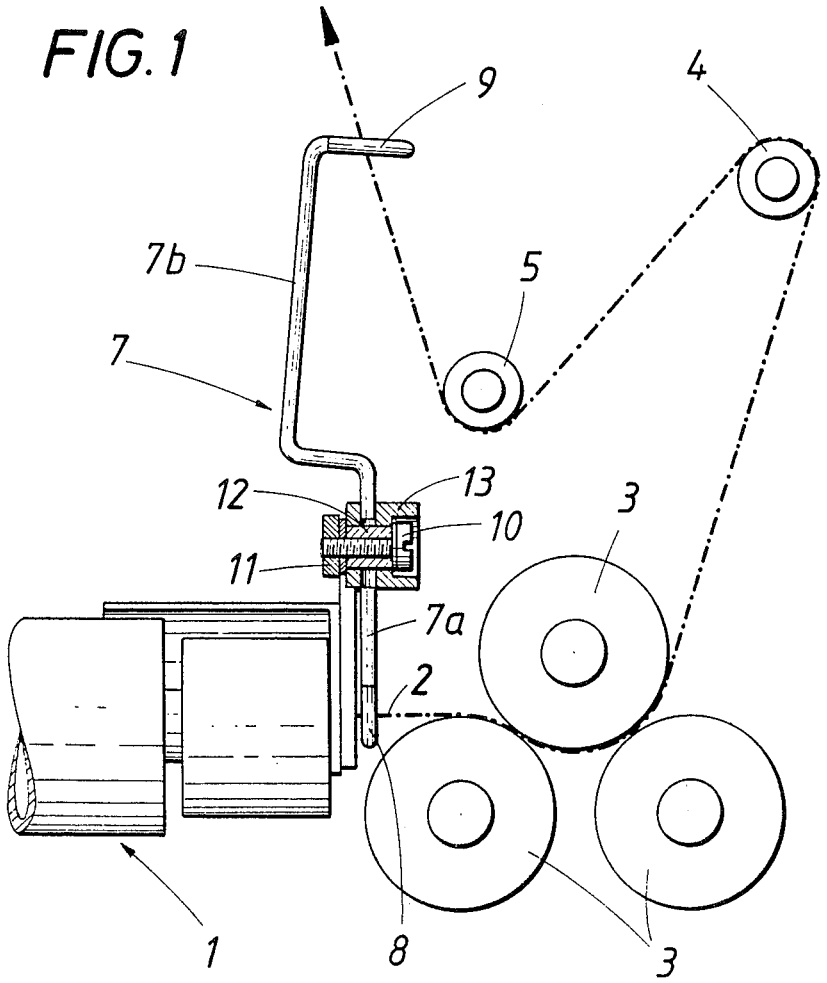

This invention relates to apparatus for withdrawing a thread from a spinning station, comprising at least two withdrawing rollers, a thread-guiding member having a reciprocating thread guide preceding the rollers, and a winding device which succeeds the rollers and comprises a traversing device.

In order to avoid a heavy local wear of, and a resulting formation of grooves in, the withdrawing rollers by the thread which is being withdrawn, the withdrawing rollers are preceded by a thread guide which is reciprocated in the longitudinal direction of the withdrawing rollers so that the thread is moved over a length portion of the withdrawing rollers in accordance with the stroke of the oscillating thread guide. The known thread guides have the disadvantage that they require a separate drive, which involves a higher structural expenditure and a larger space requirement.

It is an object of the invention to avoid these disadvantages and so to improve apparatus of the kind described hereinbefore, which serves to withdraw a thread from a spinning station, that a reciprocating thread guide preceding the withdrawing rollers can be provided by the use of simple and space-saving means.

This object is accomplished according to the invention with a thread-guiding member consisting of a double-armed lever, which is freely rotatably mounted and is provided on one arm with the thread guide which precedes the withdrawing rollers and on its other arm with a thread guide disposed between the withdrawing rollers and the traversing device.

The provision of a thread-guiding member consisting of a double-armed lever which is freely rotatably mounted permits the utilization of the traversing motion of the traversing device also for the reciprocation of the thread adjacent to the withdrawing rollers so that there is no need for separate drive means for the thread guide provided for the latter purpose. As the thread passing through that thread guide of the thread-guiding member which is disposed between the withdrawing rollers and the traversing device is reciprocated by the latter, it will carry the thread-guiding member along so that the other arm of the latter will reciprocate the thread which is guided by the other arm before the withdrawing rollers. The ratio of the effective lever arms will determine the stroke of the oscillating thread guide preceding the withdrawing rollers. Because the means for rotatably mounting the double-armed lever do not require a large space and separate drive means are not required, the thread-guiding member according to the invention has a very small space requirement and does not impose any restriction in the design of the withdrawing apparatus.

In accordance with another feature of the invention the thread-guiding member may be mounted on a bearing sleeve, through which a clamp screw serving as a pivot extends. In that case, the clamp screw bearing on the end of the bearing sleeve may be used to adjust the resistance to the rotation of the thread-guiding member. This adjustment can be used to ensure that the thread-guiding member will not perform undesired oscillations, which could otherwise occur, particularly because a certain backlash between the thread guide of the thread-guiding member and the thread is inevitable.

Figure 2:
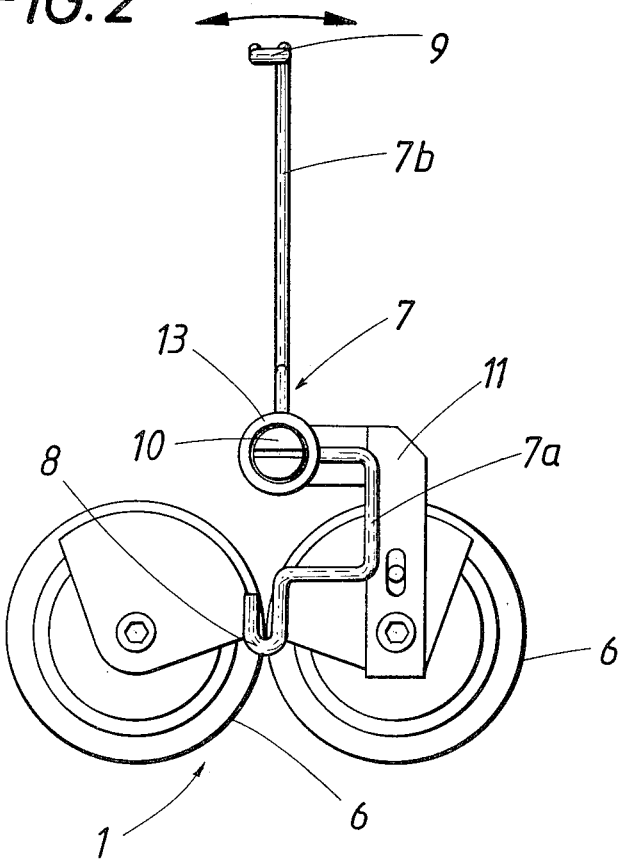
Figure 3:
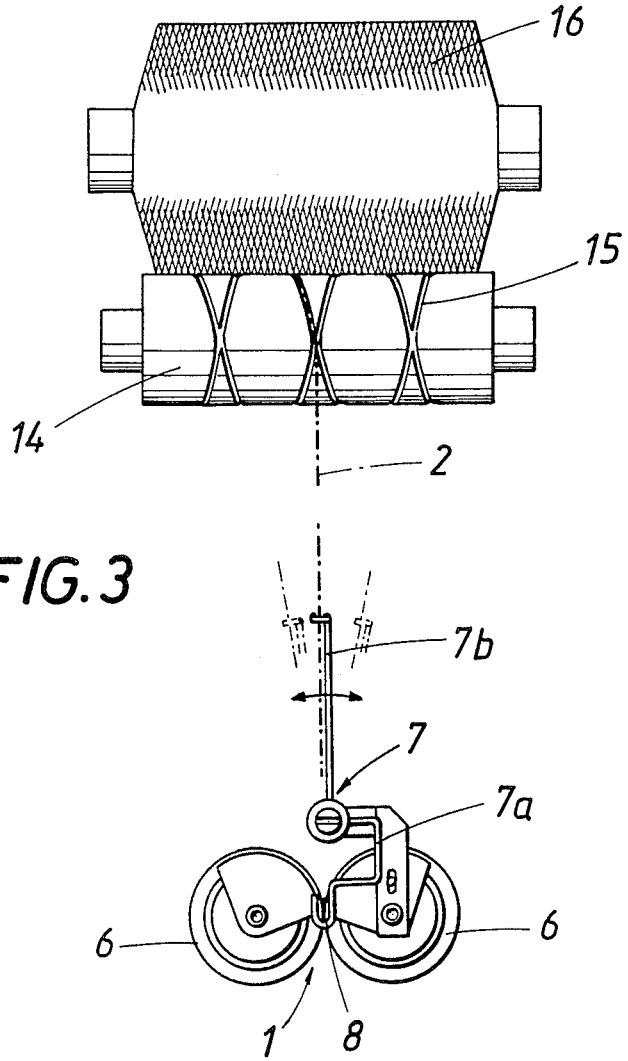

An illustrative embodiment of the invention is diagrammatically shown on the drawing, in which FIG. 1 is a simplified side elevation showing apparatus according to the invention for withdrawing a thread from a spinning station, FIG. 2 is an elevation showing the thread-guiding member viewed toward the spinning station, and FIG. 3 is a like view also showing the winding device with the traversing device.

A thread 2 coming from a spinning station 1 is withdrawn by means of withdrawing rollers 3 having parallel axes and moves around tensioning and deflecting rollers 4 and 5 to a conventional traversing device of a conventional winding device, which is shown in FIG. 3. The traversing device consists of a grooved drum 14. Thread guide grooves 15 in driven drum 14 laterally displace thread 2 as the thread is wound on spool 16 which frictionally engages the driven drum and is rotated thereby.

The spinning station consists in the present illustrative embodiment of two suction drums 6 which rotate in the same sense so that the thread is formed by twisting in the generally triangular space between the drums as the twisted thread is sucked against the rotating surfaces of the drums and firmly held in the triangular space. To permit a reciprocation of the thread 2 in the longitudinal direction of the withdrawing rollers 3 as the thread comes from the triangular space between suction drums 6, the withdrawing rollers 3 are preceded by a thread-guiding member 7 consisting of a double-armed lever which is freely rotatably mounted. One arm *7a* of the thread-guiding member 7 is formed with a slot-shaped thread guide 8 for guiding the thread 2 as it moves toward the withdrawing rollers 3. A similar thread guide 9 is provided in the other lever arm *7b* near its free end close to the traversing device 14, 15. The thread-guiding member 7 is oscillated by the thread 2 as the latter moves toward the traversing device and is guided by the thread guide 9. As a result of this oscillation, which is indicated by the double-headed arrow in FIG. 2, a corresponding motion is imparted to the thread between the spinning station 1 and the withdrawing rollers 3 in the longitudinal direction of the latter. In this way, an excessive local wear of, and a formation of grooves on, the withdrawing rollers 3 will be effectively avoided.

The bent thread-guiding member 7 is mounted on a pivot which consists of a clamp screw 10, which is adjustably screwed in a stationary carrier 11. The axis of the clamp screw 10 is perpendicular to the axes of the withdrawing rollers 3. Clamp screw 10 extends axially through a bearing sleeve 12, which is mounted in a carrier 13 and carries the thread-guiding member 7. The clamp screw 10 can be tightened so that the bearing sleeve is axially forced against the carrier 11. In this manner, the resistance to the rotation of the thread-guiding member 7 can be changed to avoid free oscillations of the thread-guiding member 7.

What is claimed is:

1. In an apparatus for withdrawing a thread from a spinning station and for delivering said thread to a winding station, the combination of (a) a plurality of withdrawing rollers arranged to withdraw said thread from said spinning station, (b) a thread traversing device arranged at the winding station to receive the thread from the withdrawing rollers and to impart to the thread received from the withdrawing rollers a traversing motion, (c) a thread winding device arranged at the winding station to receive the thread from the traversing device, and (d) a thread-guiding member consisting of a freely rotatably mounted lever, the lever having (1) a first arm provided with a first thread guide reciprocable along the withdrawing rollers and arranged to guide said thread from said spinning station to said withdrawing rollers, and (2) a second arm provided with a second thread guide arranged to guide said thread from said withdrawing rollers to said thread traversing device and to be angularly oscillated by said thread as the thread performs said traversing motion imparted to it by the traversing device.

2. In the apparatus of claim 1, a bearing sleeve for said thread-guiding member and a clamp screw constituting a pivot extending axially through said bearing sleeve.

3. In an apparatus for withdrawing a thread from a spinning station, the combination of (a) a plurality of withdrawing rollers arranged to withdraw said thread from said spinning station, and (b) a thread-guiding member consisting of a freely rotatably mounted lever, the lever having (1) a first arm provided with a first thread guide reciprocable along the withdrawing rollers and arranged to guide said thread from said spinning station to said withdrawing rollers, and (2) a second arm provided with a second thread guide arranged to guide said thread from said withdrawing rollers and to be angularly oscillated by said thread.

4. In the apparatus of claim 3, wherein the withdrawing rollers have parallel axes and the thread-guiding member is freely rotatably mounted for rotation on an axis which is perpendicular to the axes of the withdrawing rollers.

* * * * *